US008831238B2

(12) United States Patent
Rashid et al.

(10) Patent No.: US 8,831,238 B2
(45) Date of Patent: Sep. 9, 2014

(54) NOISE CANCELLATION SYSTEM

(75) Inventors: Abid Rashid, Reading (GB); Khaldoon Taha Al-Naimi, Guildford (GB)

(73) Assignee: Wolfson Microelectronics plc, Edinburgh (GB)

( * ) Notice: Subject to any disclaimer, the term of this patent is extended or adjusted under 35 U.S.C. 154(b) by 334 days.

(21) Appl. No.: 13/271,926

(22) Filed: Oct. 12, 2011

(65) Prior Publication Data

US 2012/0099736 A1 Apr. 26, 2012

Related U.S. Application Data

(60) Provisional application No. 61/406,850, filed on Oct. 26, 2010.

(30) Foreign Application Priority Data

Oct. 21, 2010 (GB) ..... 1017806.9

(51) Int. Cl.
*G10K 11/16* (2006.01)
*G10K 11/178* (2006.01)

(52) U.S. Cl.
CPC ..... *G10K 11/178* (2013.01); *G10K 2210/1081* (2013.01); *G10K 2210/3213* (2013.01)
USPC ..... 381/71.6; 381/71.1; 381/71.8

(58) Field of Classification Search
USPC ..... 381/71.1, 71.6, 71.8
See application file for complete search history.

(56) References Cited

U.S. PATENT DOCUMENTS

| | | | | |
|---|---|---|---|---|
| 8,515,089 | B2 * | 8/2013 | Nicholson | 381/71.6 |
| 2007/0003071 | A1 * | 1/2007 | Slapak et al. | 381/71.1 |
| 2010/0260345 | A1 * | 10/2010 | Shridhar et al. | 381/71.1 |

FOREIGN PATENT DOCUMENTS

| | | | |
|---|---|---|---|
| GB | 2 234 881 | A | 2/1991 |
| GB | 2 441 835 | A | 3/2008 |
| WO | WO 2009/120130 | A1 | 10/2009 |
| WO | WO 2010/117714 | A1 | 10/2010 |

* cited by examiner

*Primary Examiner* — Disler Paul
(74) *Attorney, Agent, or Firm* — Dickstein Shapiro LLP

(57) ABSTRACT

A method of controlling a noise cancellation system, for use in an audio device, comprises: generating an ambient noise signal representative of ambient noise; filtering and applying gain to the ambient noise signal to generate a noise cancellation signal; passing the noise cancellation signal to a speaker; and generating an error signal from an error microphone, wherein the gain applied to the ambient noise signal is controlled based on the error signal, and the method further comprises: determining from the error signal whether the audio device is in an off-ear position, and controlling the noise cancellation system based on said determination as to whether the audio device is in the off-ear position.

17 Claims, 3 Drawing Sheets

NOISE CANCELLATION SYSTEM

This application claims the benefit of U.S. Provisional Application No. 61/406,850, filed on Oct. 26, 2010.

BACKGROUND OF THE INVENTION

1. Field of the Invention

This invention relates to a noise cancellation system, and in particular to a noise cancellation system for inclusion in a sound reproducing device, and to a method of operation of such a noise cancellation system that is able to detect when the sound reproducing device is in a primary operating position.

2. Description of the Related Art

Noise cancellation systems are known, in which ambient noise is detected by means of one or more microphone, and the resulting ambient noise signal is applied to signal processing circuitry to generate a corresponding ambient noise cancellation signal. The ambient noise cancellation signal is then applied to a speaker, which is typically also being used to play wanted sounds to the user. Systems of this type are typically used in sound reproducing devices that are intended to be used close to the ear of the user, such as headphones, earphones or handsets, and the wanted sounds might be music, or speech, for example.

Effective noise cancellation is achieved when the signal processing circuitry generates an ambient noise cancellation signal that, when played through the speaker, generates a sound that is equal in magnitude but opposite in phase to the ambient sounds, as they reach the ear of the user. Thus, the signal processing circuitry performs a signal processing operation that must take account amongst other things of the difference between the ambient noise that is detected by the noise microphone, or microphones, and the ambient noise that reaches the ear of the user. In the case of headphones or earphones, this difference might be relatively constant, because the headphones or earphones are usually worn in a fixed position. However, in the case of a handset, this difference can vary quite substantially, because the user can hold the handset against his head in different ways.

Although noise cancellation can be effective when the desired signal processing is provided, ineffective noise cancellation can appear as an additional noise source, and can therefore be distracting to the user of the device. In addition, noise cancellation requires a power source, such as a battery, and generating ineffective noise cancellation signals is wasteful of the battery.

GB-2441835A discloses a noise cancellation system, in which an error microphone is positioned in the sound reproducing device, in order to detect the sounds that reach the ear of the user. The signals from the error microphone are then used to adapt the signal processing circuitry, which can then be used to generate effective noise cancellation. However, when the sound reproducing device is positioned away, or completely removed, from the user's ear, the noise cancellation system is unable to provide effective noise cancellation.

It is known to provide a proximity detector in a mobile phone handset to detect when the handset is against the users' head. For example, the proximity detector can be based on an infrared source and detector.

SUMMARY OF THE INVENTION

According to a first aspect of the present invention, there is provided a method of controlling a noise cancellation system, for use in an audio device, the method comprising:

generating an ambient noise signal representative of ambient noise;

filtering and applying gain to the ambient noise signal to generate a noise cancellation signal;

passing the noise cancellation signal to a speaker; and generating an error signal from an error microphone, wherein the gain applied to the ambient noise signal is controlled based on the error signal, and the method further comprising:

determining from the error signal whether the audio device is in an off-ear position, and controlling the noise cancellation system based on said determination as to whether the audio device is in the off-ear position.

According to a second aspect of the present invention, there is provided a noise cancellation system, for use with an audio device, the noise cancellation system comprising:

a first input for receiving an ambient noise signal representative of ambient noise;

a filter circuit for filtering and applying gain to the ambient noise signal to generate a noise cancellation signal;

an output for the noise cancellation signal;

a second input for receiving an error signal from an error microphone; and a controller for controlling the gain applied to the ambient noise signal based on the error signal, and the controller being further adapted to:

determine from the error signal whether the audio device is in an off-ear position, and control the noise cancellation system based on said determination as to whether the audio device is in the off-ear position.

According to a third aspect of the present invention, there is provided an audio system, comprising:

an audio device, comprising a first microphone, for generating an ambient noise signal representative of ambient noise; a speaker; an error microphone located close to the speaker; and a noise cancellation system according to the second aspect of the invention, wherein the first microphone is connected to the first input of the noise cancellation system, the error microphone is connected to the second input of the noise cancellation system, and the speaker is connected to the output of the noise cancellation system.

This may have the advantages that it can be determined without using additional devices that the audio device is in an off-ear position, and/or that the noise cancellation system can be controlled in order to avoid at least some unwanted effects when the device is placed back on or about the user's ear.

DETAILED DESCRIPTION OF PREFERRED EMBODIMENTS

Figure 1:
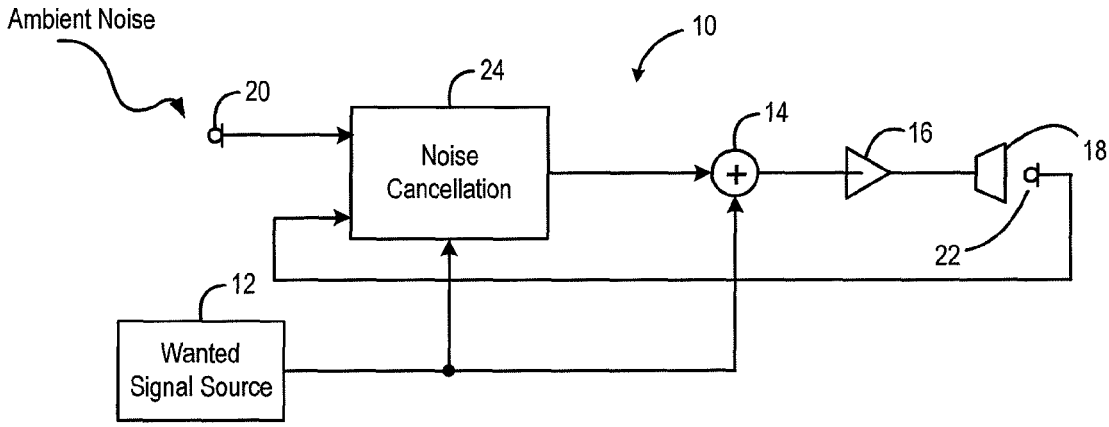
FIG. 1 is a schematic diagram of a first sound reproduction device in accordance with an aspect of the present invention.

FIG. 1 shows the general form of a sound reproduction device 10, having a wanted signal source 12. The sound reproduction device 10 may for example be a mobile phone handset, in which case the wanted signal source 12 may be the circuitry that generates the signal representing the voice that has been transmitted to the mobile phone. As another example, the sound reproduction device 10 may be an earphone, in which case the wanted signal source 12 may be an input for receiving a signal from a playback device, or the like.

The wanted signal is applied through a first input of an adder 14 to a speaker driver amplifier 16, and to a speaker 18.

The sound reproduction device 10 also includes a first microphone 20, for detecting ambient noise in the vicinity of the sound reproduction device. The sound reproduction device 10 also includes a second microphone 22. As described in more detail below, the second microphone 22 detects sounds in the vicinity of the speaker 18.

Signals from the first microphone 20 and the second microphone 22, and wanted signals from the wanted signal source 12, are applied to noise cancellation circuitry 24. The noise cancellation circuitry 24 generates a noise cancellation signal, which is applied to a second input of the adder 14, so that it is added to the wanted signal as the latter is applied to the speaker driver amplifier 16, and to the speaker 18.

If the signal processing performed in the noise cancellation circuitry 24 can be controlled appropriately, then the effect of applying the noise cancellation signal to the speaker 18 is to generate a sound that will cancel out the ambient noise to at least some extent, thereby making the wanted sounds more clearly audible.

Figure 2:
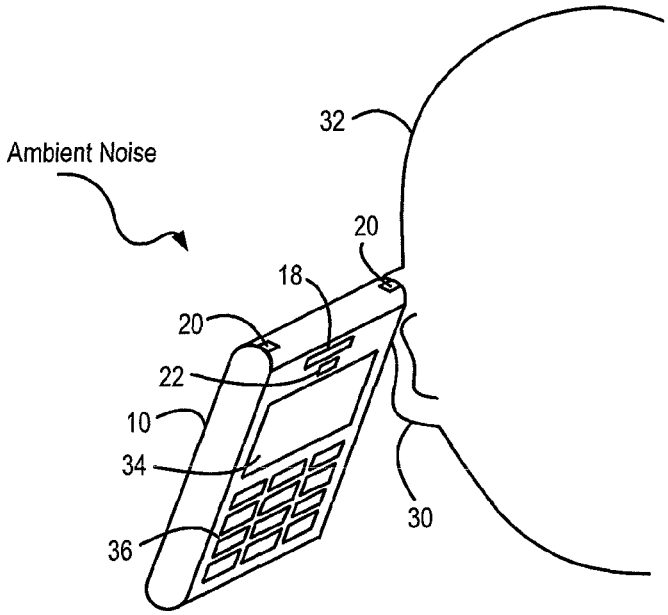
FIG. 2 shows the sound reproduction device of FIG. 1 in use.

FIG. 2 shows the sound reproduction device 10 in use. Specifically, in this illustrated example, the sound reproduction device 10 takes the form of a mobile phone handset, which is shown positioned against the outer ear 30 on the head 32 of the user. As is conventional, the handset includes a speaker 18 on its front surface, towards the upper end thereof, above a display 34 and a keypad 36.

In this illustrated example, there are two first microphones 20, positioned on opposite sides of the upper edge of the handset, such that they can detect ambient noise that will be heard by the user.

The second microphone 22 is positioned close to, for example in front of, the speaker 18.

Figure 3:
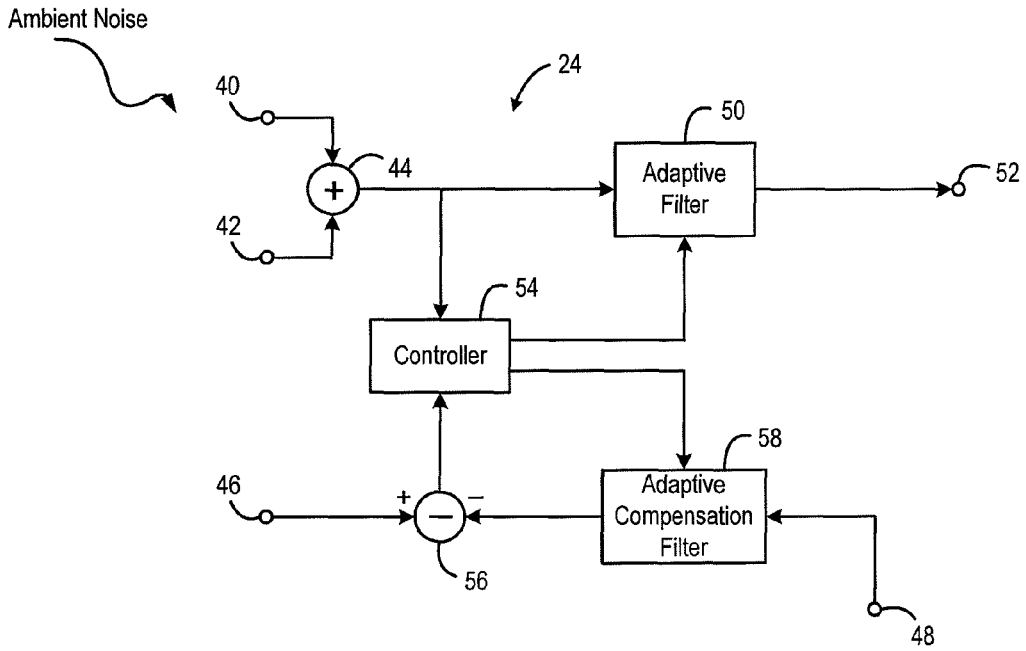
FIG. 3 is a schematic diagram of a noise cancellation system in the sound reproduction device of FIG. 1, in accordance with an aspect of the present invention.

FIG. 3 shows in more detail the form of the noise cancellation circuitry 24. In this case, the noise cancellation takes the form of adaptive feedforward noise cancellation. That is, the signal representing the detected ambient noise is filtered, and the resulting noise cancellation signal is applied to the speaker. At the same time, an error signal is generated by a microphone close to the speaker, and the error signal is used to adapt the form of the filtering that is applied.

Thus, the noise cancellation circuitry 24 shown in FIG. 3 includes first inputs 40, 42, for receiving signals from the two first microphones 20, and an adder 44 for forming a combined signal that represents the ambient noise. The noise cancellation circuitry 24 also includes a second input 46, for receiving signals from the second microphone 22, and a third input 48, for receiving signals from the wanted signal source.

The ambient noise signal output by the adder 44 is applied to an adaptive filter 50 to generate an ambient noise cancellation signal, which is supplied to an output terminal 52 for eventual application to the speaker 18 as described above.

As is well known, effective noise cancellation requires that the filter characteristics of the filter 50 should be well matched to the other characteristics (for example, acoustical, mechanical and hardware characteristics) of the system. Thus, the filter 50 can have a frequency response characteristic that compensates for any frequency dependent variations in the responses of the noise microphones 20 or the loudspeaker 18. Also, the filter 50 can have a frequency response characteristic that compensates for any frequency dependent variations in the ambient noise that reaches the user's ear around the handset as it is held close to the user's head. These characteristics of the filter 50 can be preset, based on knowledge of the handset in which the noise cancellation system 24 is to be used.

In addition, in this illustrated example, the filter characteristics of the filter 50 are adapted in use, based on the signals received from the second microphone 22, which represent the error, i.e. the extent to which the signals reaching the ear of the user contain uncompensated ambient sounds, or contain sounds generated by the noise cancellation system that overcompensate for the actual ambient noise. In certain embodiments, the frequency dependent aspects of the filter characteristic can be adapted.

In this illustrated example, the gain of the adaptive filter 50 is adapted based on the signals received from the second microphone 22, as described in more detail below. The signals from the second microphone 22 are received on the second input 46, and passed to a first input of a subtractor 56. The wanted input signals applied to the third input 48 are passed through an adaptive compensation filter 58 before being passed to a second input of the subtractor 56, so that the effect of the wanted signal is removed from the detected error signal.

Figure 4:
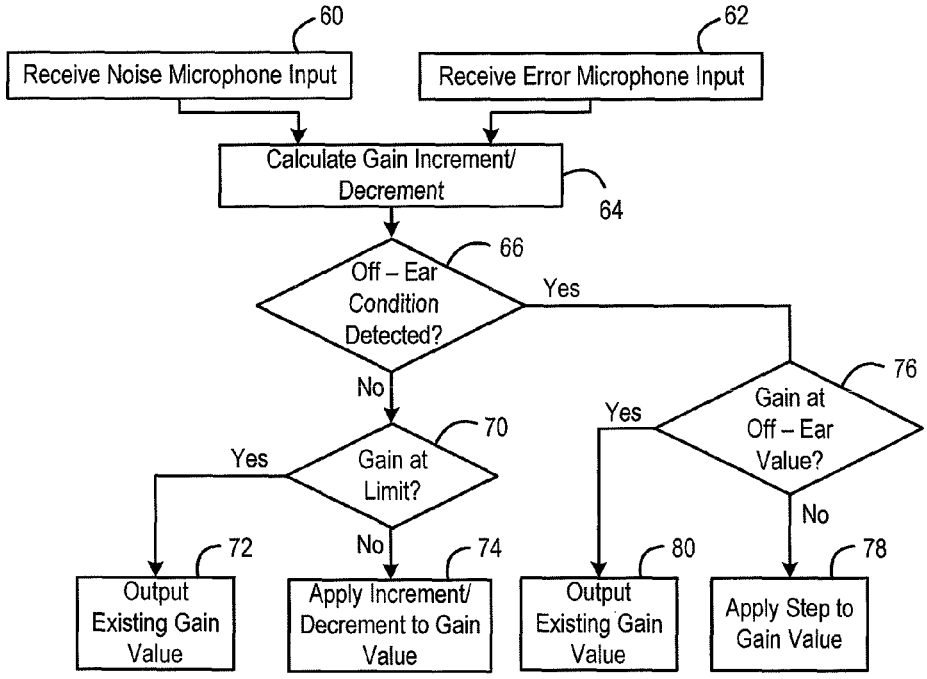
FIG. 4 is a flow chart, illustrating the method of setting a gain value, in the noise cancellation system of FIG. 3.

Specifically, the noise cancellation system 24 includes a controller 54, for example in the form a digital signal processor, and FIG. 4 is a flow chart, illustrating the process performed in the controller 54. Although the discussion herein refers to the gain of the adaptive filter 50 being adapted, the gain of the adaptive compensation filter 58 must be adapted in a similar way, and the output from the controller 54 also controls this gain value.

As discussed above, the error microphone 22 captures the residual of the ambient noise and the anti-noise signal, produced by the noise cancellation system 24, that is played out of the speaker 18. If no anti-noise signal is generated, or the anti-noise signal is less than the ambient noise signal, then the residual signal, or error signal, will be in phase with the ambient noise detected by the microphone(s) 20. If the anti-noise signal is higher than the ambient noise signal entering into the ear, then the residual signal, or error signal, will be out of phase with the ambient noise signal. Therefore, in this example, an algorithm that monitors the phase relation of the signals from the ambient noise microphone and the error microphone is used to adjust the gain of the noise cancellation system to converge to its optimum gain value.

Referring to FIG. 4, in step 60, the process takes the signal received from the ambient noise microphones 20, and in step 62 it takes the signal received from the error microphone 22.

In each case, these signals are passed to a Fast Fourier Transform (FFT) block, in which data is sampled at 7.8 kHz and buffered to a block size of 128 samples. The process then examines the phases of the signal components at a number of frequencies in the frequency range over which noise cancellation is intended to be performed. In this example, the processor examines the phases in a Cartesian co-ordinate space of components of the signals received from the ambient noise microphones and the error microphone at 500 Hz, 560 Hz, 620 Hz, 680 Hz, 740 Hz and 800 Hz.

In step 64, the phase difference between the signals received from the ambient noise microphones and the error microphone is calculated at each of these frequencies. Each of these calculated phase differences is then compared with 90°, with a decision of +1 being returned when the phase difference is less than 90°, and a decision of −1 being returned when the phase difference is greater than 90°. Then, the sum of these decisions is calculated. That is, if the calculated phase difference at all six frequencies is less than 90°, a sum of +6 is formed, while if the calculated phase difference at all six frequencies is greater than 90°, a sum of −6 is formed, and intermediate sums can be formed if the six phase differences at the six frequencies do not all give the same result when compared with 90°.

If it is found that the sum of these decisions is greater than a predetermined threshold, typically zero, a positive value is output. If it is found that the sum of these decisions is less than the predetermined threshold, a negative value is output. If the sum of these decisions is equal to the threshold, a zero is output.

These output values are generated once per frame, or block of 128 samples.

If the output value is negative, it is determined that the anti-noise is higher in magnitude than the ambient noise entering the ear, and so a gain decrement value is output. If the output value is positive, it is determined that the anti-noise is less in magnitude than the ambient noise entering the ear, and so a gain increment value is output.

For example, a gain decrement value of fixed size is output whenever the average decision indicates that the phase difference is greater than 90°, and a gain increment value of the same fixed size is output whenever the average decision indicates that the phase difference is less than 90°.

As discussed above, the noise cancellation system 24 can cope well with the situation where the handset 10 is on, or positioned about, the user's ear, but is moved a small distance such that the amount of ambient noise reaching the user's ear changes slightly.

However, problems can arise when the handset 10 is removed from, or positioned away from, the user's ear. Specifically, when the handset is off the ear and exposed to the free air, the error signal will be overwhelmed by the ambient noise signal, and the small size of the speaker 18 will mean that it is unable to produce enough energy to cancel the ambient noise. In that case, step 64 will continue to output gain increment values, even when the gain value has reached its maximum value.

Thus, in the process of FIG. 4, it is determined in step 66 whether an off-ear condition is detected. If it is determined that the handset is on, or about, the user's ear, the process passes to step 70, in which it is determined whether the gain value supplied from the controller to the adaptive filter 50 to be applied to the detected ambient noise signal, is at the relevant limiting value. Thus, if step 64 has output a gain increment value, it is determined in step 70 whether the current gain value is at a preset upper limiting gain value, and if step 64 has output a gain decrement value, it is determined in step 70 whether the current gain value is at a preset lower limiting gain value.

If it is determined in step 70 that the current gain value is at the relevant limiting gain value, then in step 72 the existing gain value continues to be output, but if it is determined in step 70 that the current gain value is not at the relevant limiting gain value, then in step 74 a new gain value is formed by applying the calculated increment or decrement to the existing gain value and the new gain value is output.

If it is determined in step 66 that an off-ear condition has been detected, the process passes to step 76, in which it is determined whether the gain value supplied from the controller to the adaptive filter 50 to be applied to the detected ambient noise signal, is at a predetermined off-ear value, which lies between the upper and lower limiting gain values mentioned above.

If it is determined in step 76 that the current gain value is at the predetermined off-ear gain value, then in step 80 the existing gain value continues to be output, but if it is determined in step 76 that the current gain value is not at the predetermined off-ear gain value, then in step 78 a new gain value is formed by applying a negative step value to the existing gain value and the new gain value is output.

Figure 5:
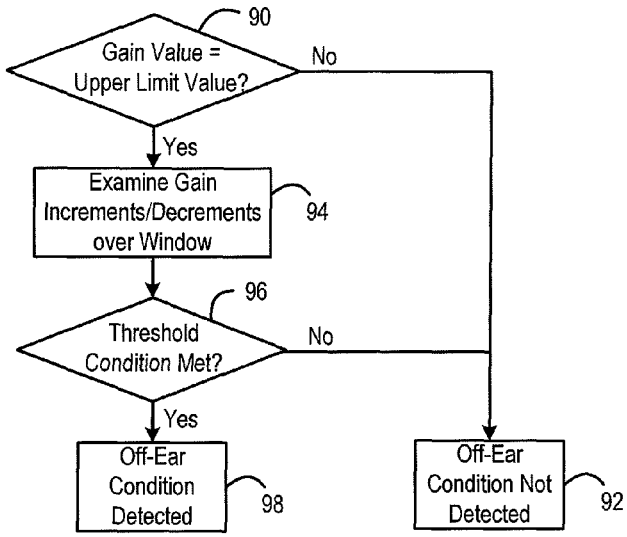
FIG. 5 is a flow chart, illustrating in more detail a part of the method illustrated in FIG. 4.
Figure 6:
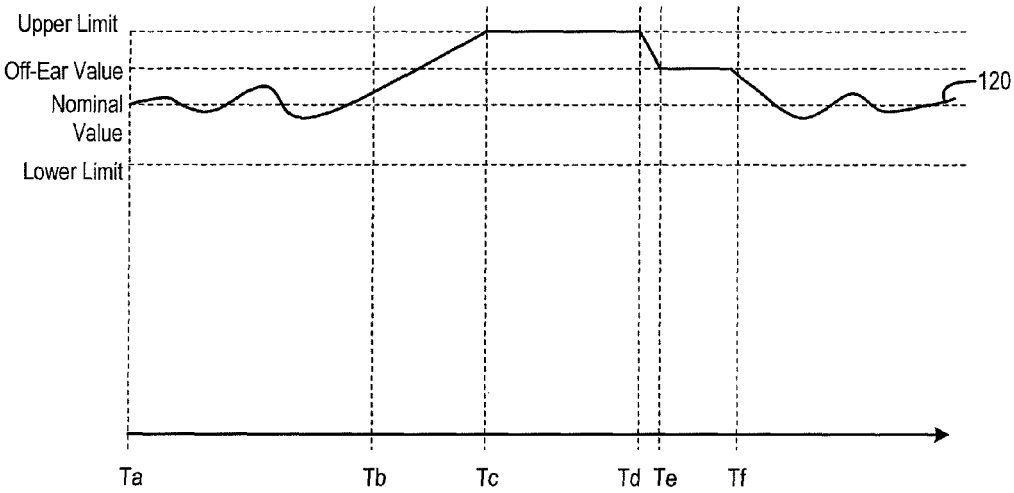
FIG. 6 illustrates a possible result of the method of FIGS. 4 and 5.

FIG. 5 is a further flow chart, showing in more detail how the process determines in step 66 whether an off-ear condition is to be detected, and FIG. 6 shows the time history of various values in an illustrative example of the operation of the system.

In step 90 of the process shown in FIG. 5, it is determined whether the current gain value output by the controller 54 is at the predetermined upper limiting value.

In the time period Ta-Tb shown in FIG. 6, the handset 10 is being held against the user's ear. During this operation, the position of the handset might be changing slightly, and so the process of FIG. 4 will typically be calculating an appropriate stream of increment and decrement values, as described with reference to step 64 in FIG. 4, with the result that the calculated gain value, indicated by the line 120 in FIG. 6, stays close to the middle of the range between the upper and lower limit values. Typically, the gain value 120 should be expected to fluctuate around the nominal value, which causes the adaptive filter 50 to apply a gain in the middle of its range of possible values.

As the gain value is not equal to the upper limiting value, the answer to the question in step 90 is negative, and the process passes to step 92, with the result that the process of FIG. 4 passes from step 66 to step 70.

At time Tb, the handset 10 is moved away from the user's ear, and the result is that the calculation in step 64 starts to output a substantially continuous stream of increment values. Thus, during the time period Tb-Tc shown in FIG. 6 the gain value 120 is continually increasing, until it reaches the upper limiting value at the time Tc. As the gain value is not equal to the upper limiting value in the time period Tb-Tc, the answer to the question in step 90 remains negative, and the process passes to step 92, with the result that the process of FIG. 4 passes from step 66 to step 70.

When the gain value 120 reaches the upper limiting value at the time Tc, the answer to the question in step 90 becomes positive, and the process passes to step 94. In step 94, the gain increment or decrement values most recently calculated in step 64 are examined.

In step 96, it is determined whether a threshold condition is met. For example, the gain increment or decrement values calculated over a sliding window, which may for example again be of length 10 frames, are examined. The threshold condition might then for example be satisfied if some threshold number of increment values, such as 8, 9 or 10, is found to have been generated during that 10 frame window.

If the threshold condition described in step 96 has not been met, as during the period Tc-Td in FIG. 6, it is determined that the off-ear condition has not yet been met, and the process passes to step 92, with the result that the process of FIG. 4 passes from step 66 to step 70.

At time Td in FIG. 6, it is determined that the off-ear condition has been met, and the process passes to step 98, with the result that the process of FIG. 4 passes from step 66 to step 76.

In step 76, it is determined whether the current gain value is equal to the predetermined off-ear value. Initially, it will be equal to the upper limiting value, which is higher than the off-ear value, and so the process will pass to step 78, and the negative step will be applied to the current gain value.

When the negative step has been applied to the current gain value often enough for the current gain value to become equal to the predetermined off-ear value, at time Te, the determination at step 76 becomes positive, and thereafter the process of FIG. 4 passes to step 80, in which an unchanged gain value is output. Thus, while the handset 10 is held away from the user's ear for a protracted period, the gain is ramped to the off-ear value. This prevents the situation where, if the gain value were instead maintained at the upper limiting value, the user would notice an unnecessarily (and perhaps unacceptably) large amount of anti-noise energy when placing the handset back on his ear.

This gain value unchanged at the off-ear value persists until time Tf, at which it is determined that the off-ear condition no longer applies, and thereafter the process of FIG. 4 passes from step 66 to step 70, as described previously. For example, when it is found that the most recently calculated increment or decrement values are not all, or are not predominantly, increment values, as discussed above with reference to steps 66 and 96, it can be determined that the off-ear condition no longer applies. Thereafter, the process of FIG. 4 can pass from step 66 to step 70, rather than to step 76.

Thus, there is provided a mechanism for ensuring that the gain value applied to the adaptive filter 50 takes account of the situation when the device is held off the ear of the user.

Although the invention has been described here with reference to its use in a handset, the same principle can be used in other devices that include noise cancellation, such as headphones, earphones or the like. Where the method described herein is used in headphones or earphones having a pair of speakers, the method can be applied separately to the signals applied to those two speakers. Thus, when a pair of earbuds includes an ambient noise microphone and an error microphone on each earbud, it is possible to determine separately from the signals received from these microphones whether each earbud is in an off-ear condition.

When it is determined that one earbud of a pair of earbuds is in an off-ear condition, the gain applied to the noise cancellation signal in that one earbud can be controlled appropriately, as described above. Alternatively, when it is determined that one earbud of a pair of earbuds is in an off-ear condition, it is possible to stop sending the wanted signal and the noise cancellation signal to that one earbud to save power. Alternatively, or additionally, the wanted signals and the noise cancellation signals to a pair of earbuds can be switched off completely when it is determined that both earbuds of a pair are in an off-ear condition.

What is claimed is:

1. A method of controlling a noise cancellation system, for use in an audio device, the method comprising:

generating an ambient noise signal representative of ambient noise;

filtering and applying gain to the ambient noise signal to generate a noise cancellation signal;

passing the noise cancellation signal to a speaker; and generating an error signal from an error microphone, wherein the gain applied to the ambient noise signal is controlled based on a gain increment/decrement value derived from the error signal, and the method further comprising:

determining from the gain increment/decrement value or the applied gain whether or not the audio device is in an off-ear position, and controlling the noise cancellation system differently based on said determination as to whether or not the audio device is in the off-ear position.

2. A method as claimed in claim 1, comprising:

determining based on the error signal and the ambient noise signal whether the gain applied to the ambient noise signal should be increased or decreased from a current gain value, within a range defined by an upper limiting value and a lower limiting value.

3. A method as claimed in claim 2, comprising:

determining based on a phase difference between the error signal and the ambient noise signal whether the gain applied to the ambient noise signal should be increased or decreased from the current gain value.

4. A method as claimed in claim 2, comprising adjusting the gain to be applied to the ambient noise signal to a predetermined off-ear value between the upper limiting value and the lower limiting value in response to a determination that the audio device is in the off-ear position.

5. A method as claimed in claim 4, comprising adjusting the gain to be applied to the ambient noise signal to the off-ear value by a series of steps.

6. A method as claimed in claim 2, comprising determining that the audio device is in the off-ear position in response to a succession of determinations that the gain to be applied to the ambient noise signal should be increased.

7. A method as claimed in claim 6, comprising determining that the audio device is in the off-ear position in response to a succession of determinations that the gain to be applied to the ambient noise signal should be increased, following a determination that the gain has reached the upper limiting value.

8. A noise cancellation system, for use with an audio device, the noise cancellation system comprising:

a first input for receiving an ambient noise signal representative of ambient noise;

a filter circuit for filtering and applying gain to the ambient noise signal to generate a noise cancellation signal;

an output for the noise cancellation signal;

a second input for receiving an error signal from an error microphone; and a controller for controlling the gain applied to the ambient noise signal based on a gain increment/decrement value derived from the error signal, and the controller being further adapted to:

determine from the gain increment/decrement value or the applied gain whether or not the audio device is in an off-ear position, and control the noise cancellation system differently based on said determination as to whether or not the audio device is in the off-ear position.

9. A noise cancellation system as claimed in claim 8, wherein the controller is adapted to:

determine based on the error signal and the ambient noise signal whether the gain applied to the ambient noise signal should be increased or decreased from a current gain value, within a range defined by an upper limiting value and a lower limiting value.

10. A noise cancellation system as claimed in claim 9, wherein the controller is adapted to:

determine based on a phase difference between the error signal and the ambient noise signal whether the gain applied to the ambient noise signal should be increased or decreased from the current gain value.

11. A noise cancellation system as claimed in claim 9, wherein the controller is adapted to adjust the gain to be applied to the ambient noise signal to an off-ear value between the upper limiting value and the lower limiting value in response to a determination that the audio device is in the off-ear position.

12. A noise cancellation system as claimed in claim 11, wherein the controller is adapted to adjust the gain to be applied to the ambient noise signal to the off-ear value by a series of steps.

13. A noise cancellation system as claimed in claim 9, wherein the controller is adapted to determine that the audio device is in the off-ear position in response to a succession of determinations that the gain to be applied to the ambient noise signal should be increased.

14. A noise cancellation system as claimed in claim 13, wherein the controller is adapted to determine that the audio device is in the off-ear position in response to a succession of determinations that the gain to be applied to the ambient noise signal should be increased, following a determination that the gain has reached the upper limiting value.

15. An audio system, comprising:

an audio device, comprising a first microphone, for generating an ambient noise signal representative of ambient noise; a speaker; an error microphone located close to the speaker; and a noise cancellation system as claimed in any of claim 8, wherein the first microphone is connected to the first input of the noise cancellation system, the error microphone is connected to the second input of the noise cancellation system, and the speaker is connected to the output of the noise cancellation system.

16. An audio system as claimed in claim 15, wherein the audio system comprises a handset device.

17. An audio system as claimed in claim 16, wherein the audio system comprises a mobile phone handset.

* * * * *